US010555631B2

(12) United States Patent
Bishop

(10) Patent No.: US 10,555,631 B2
(45) Date of Patent: Feb. 11, 2020

(54) CHIP AND DIP TRAY

(71) Applicant: Mischa Bishop, Muscle Shoals, AL (US)

(72) Inventor: Mischa Bishop, Muscle Shoals, AL (US)

( * ) Notice: Subject to any disclaimer, the term of this patent is extended or adjusted under 35 U.S.C. 154(b) by 0 days.

(21) Appl. No.: 15/942,539

(22) Filed: Apr. 1, 2018

(65) Prior Publication Data

US 2019/0090672 A1 Mar. 28, 2019

Related U.S. Application Data

(63) Continuation of application No. 29/618,866, filed on Sep. 25, 2017.

(51) Int. Cl.
*A47G 23/06* (2006.01)
*B65D 43/02* (2006.01)

(52) U.S. Cl.
CPC ..... *A47G 23/06* (2013.01); *B65D 43/0212* (2013.01); *B65D 2543/00092* (2013.01); *B65D 2543/00416* (2013.01)

(58) Field of Classification Search
CPC ..... A47G 23/06; B65D 43/0212; B65D 2543/00092; B65D 2543/00416; B65D 81/3216
USPC ..... 206/546, 541; 220/23.83, 23.86, 23.87, 220/575, 574, 23.89
See application file for complete search history.

(56) References Cited

U.S. PATENT DOCUMENTS 5,366,103 A * 11/1994 Abernathy ..... A47G 19/02 220/23.83
5,743,210 A * 4/1998 Lampe ..... A01K 5/0114 119/51.5
6,116,455 A * 9/2000 Rossman ..... B65D 81/365 220/23.83
6,729,472 B2 * 5/2004 Stucke ..... A47G 19/23 206/515
7,874,449 B1 * 1/2011 Studee ..... A47G 19/02 206/219
8,011,205 B2 * 9/2011 Roth ..... A47J 41/0044 62/457.6
8,807,368 B1 * 8/2014 Riedel ..... A47G 23/06 206/514
8,857,802 B1 * 10/2014 Geier ..... A47G 19/02 269/9
9,545,165 B2 * 1/2017 Roth ..... A47J 41/0044
2007/0029331 A1 * 2/2007 George ..... A47G 19/06 220/574
2008/0156812 A1 * 7/2008 Chai ..... B65D 43/0202 220/575
2008/0173650 A1 * 7/2008 Roth ..... A47J 41/0044 220/574.1

(Continued)

*Primary Examiner* — Steven A. Reynolds
(74) *Attorney, Agent, or Firm* — Dennen IP Law, LLC

(57) ABSTRACT

A chip and dip container has a dip bowl that couples to a dip bowl lid, and the dip bowl has a circular, vertically-extending protrusion that extends from a bottom surface of the dip bowl. Additionally, the chip and dip container has a chip bowl that couples to a chip bowl lid, and the chip bowl has a vertically-extending, circular wall centrally located on a floor of the chip bowl and forming a first opening, the first opening configured and sized to secure the vertically-extending protrusion thereby limiting movement of the dip bowl when in transport or when stored.

4 Claims, 4 Drawing Sheets

(56) References Cited

U.S. PATENT DOCUMENTS

| | | | | |
|---|---|---|---|---|
| 2009/0108004 | A1* | 4/2009 | Bollengier | A47G 19/02<br>220/574 |
| 2014/0246443 | A1* | 9/2014 | Roth | A47J 41/0044<br>220/574.1 |
| 2014/0326723 | A1* | 11/2014 | Scharfe | A47G 19/2283<br>220/23.83 |

* cited by examiner

CHIP AND DIP TRAY

CROSS REFERENCE TO RELATED APPLICATION

This application claims priority to U.S. Design Application Ser. No. 29/618,866 entitled Chip and Dip Tray, and filed on Sep. 25, 2017, which is incorporated by reference.

BACKGROUND

At parties or other types of events, attendees often bring chips and dip to be shared by the participants of the event. Oftentimes, chips are contained in one bowl having a lid, and the dip is contained in a separate bowl having a lid. When served to participants at the event, the lids are removed. Because the lids are removed from the bowls, the lids may become lost during the event.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure describes a chip and dip container in accordance with an embodiment of the present disclosure. The chip and dip container comprises a chip bowl and a dip bowl, and each bowl comprises a respective lid. The chip bowl comprises a central circular wall in a bottom surface of the chip bowl configured for receiving the dip bowl. Further, the lid for the chip bowl comprises an opening configured for receiving the dip bowl lid when the chip and dip container is not in use. Additionally, the chip bowl lid has an opening defined by a wall in a bottom surface, and the chip bowl lid retains the dip bowl lid in the opening when the chip and dip container is in use.

Figure 1:
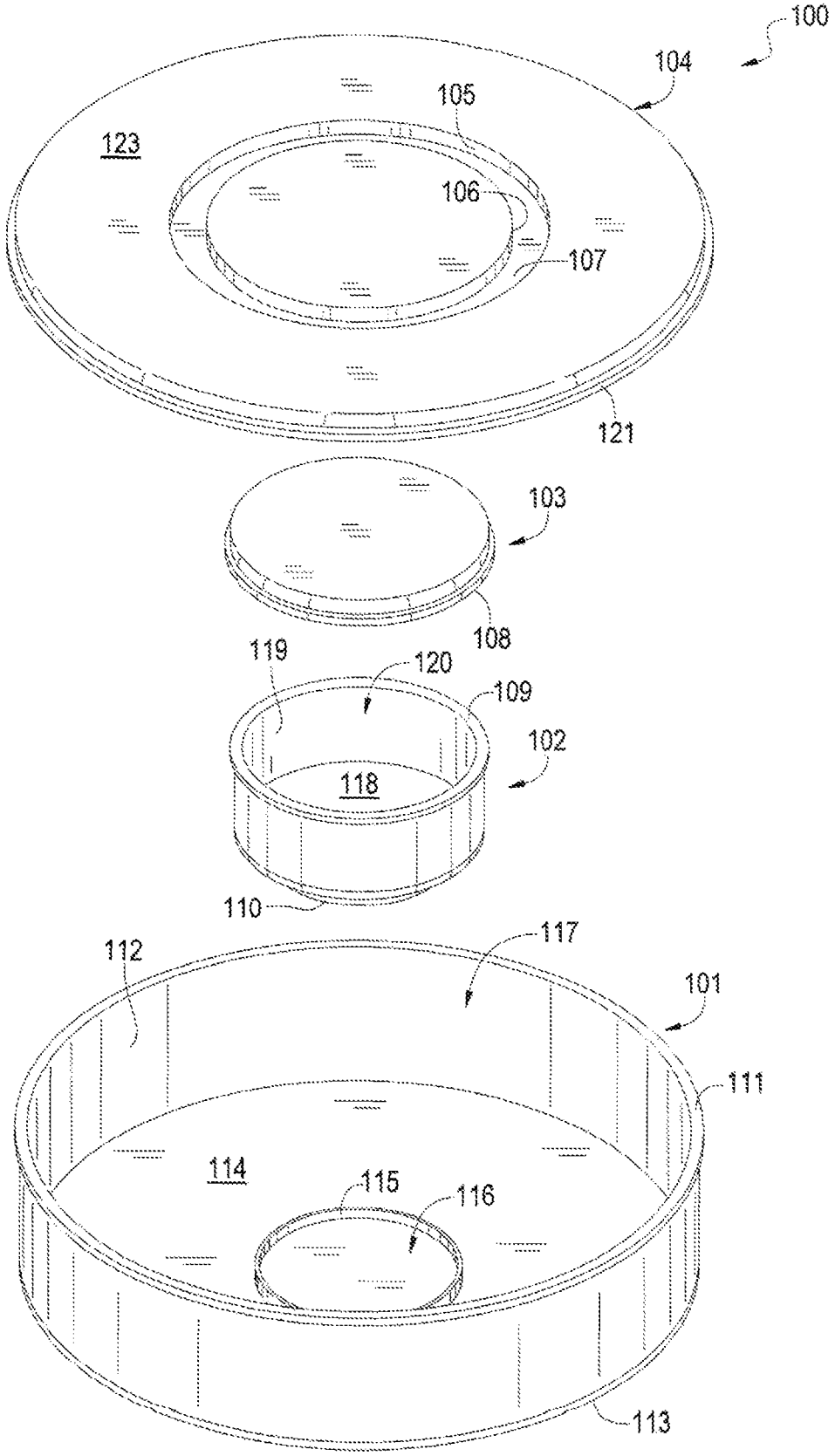
FIG. 1 is a top exploded perspective view of a chip and dip container in accordance with an embodiment of the present disclosure.

FIG. 1 depicts an exploded perspective view of a chip and dip container 100 in accordance with an embodiment of the present disclosure. The chip and dip container 100 comprises a chip bowl 101, a dip bowl 102, a dip bowl lid 103 configured to fit over and seal the dip bowl 102, and a chip bowl lid 104 that fits over and seals the chip bowl 101. The chip bowl 101 and the dip bowl 102 and corresponding lids 104 and 103 are shown as circular; however, they may be different shapes and sizes in other embodiments of the present disclosure.

The chip bowl 101 comprises a circular floor 114. Extending vertically from the circular floor 114 is a vertical wall 112, and the floor 114 and the vertical wall 112 create a cavity 117 configured for receiving chips (not shown).

The chip bowl 101 further comprises a circular wall 115 centrally and vertically extending from the floor 114 of the chip bowl 101 creating a circular opening 116. As will be discussed further herein, the circular wall 115 and opening 116 are circumferentially sized and adapted for receiving a circular protrusion 110 extending from the bottom of the dip bowl 102. In this regard, the circumference of the protrusion 110 is smaller than the circumference of the circular opening 116 such that the bottom circular protrusion 110 fits within and is secured by the circular wall 115.

The chip bowl 101 further comprises a ledge 111 configured for receiving and coupling to a lip 121 of the chip bowl lid 104. When the chip bowl 101 is not in use, the chip bowl lid 104 covers the cavity 117 to retain chips (not shown) in the cavity 117 or for storage when the chip and dip container 100 is not in use.

The dip bowl 102 comprises a circular floor 118. Extending vertically from the circular floor 118 is a vertical wall 119. The floor 118 and the vertical wall 119 create a cavity 120 configured for receiving dip (not shown).

The dip bowl 102 further comprises a circular, vertically-extending protrusion 110 extending from a bottom surface of the dip bowl 102. The protrusions 110 is circumferentially configured and sized to fit within the opening 116 created by the circular wall 115 of the chip bowl 101. Thus, during use and during storing, the opening 116 and the circular wall 115 retain and secure the dip bowl 102.

The dip bowl 102 further comprises a ledge 109 for receiving a lip 108 of the chip bowl lid 103. When the dip bowl 102 is not in use, the dip bowl lid 103 covers the cavity 120 to retain dip in the cavity 120 or for storage when the chip and dip container 100 is not in use.

The chip bowl lid 104 is configured to cover the cavity 117, to retain chips in the cavity 117, or for storage when the chip and dip container 100 is not in use. The chip bowl lid 104 comprises a channel 107 formed in a top surface 123 of the chip bowl lid 104. The channel 107 is formed by a vertical, outer circular wall 105 and a vertical, inner circular wall 106. As will be described further with reference to FIG. 2, the channel 107 creates an opening 202 (FIG. 2) on an opposing side of the chip bowl lid 104 for receiving and retaining the dip bowl 102 when chips and dip are being transported or when the chip and dip container 100 is being stored.

Figure 2:
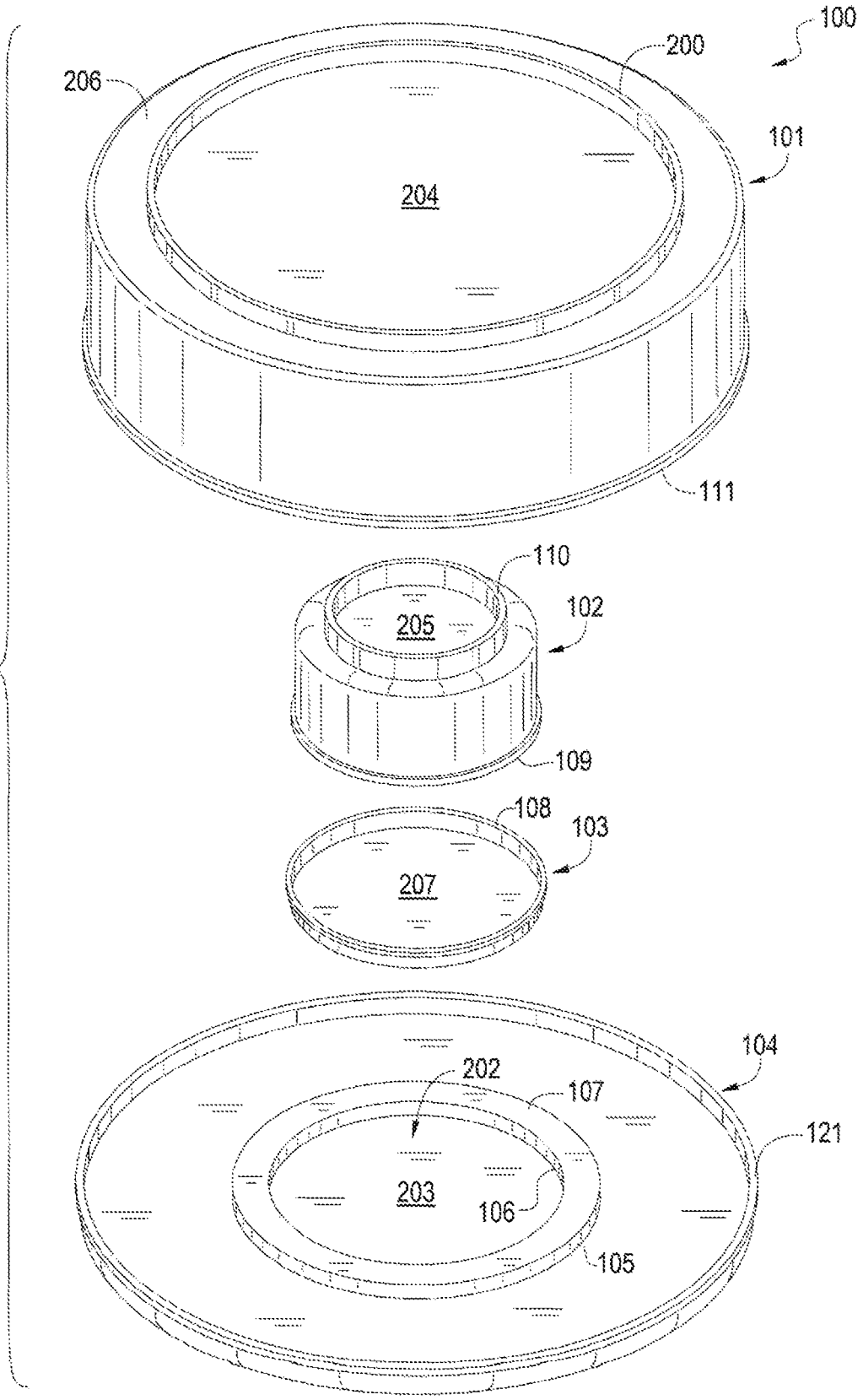
FIG. 2 is bottom exploded perspective view of the chip and dip container of FIG. 1.

FIG. 2 is a bottom perspective exploded view of the chip and dip container 100. The chip and dip container 100 comprises the chip bowl 101, the dip bowl 102, the dip bowl lid 103, and the chip bowl lid 104.

The chip bowl lid 104 comprises the channel 107, as described above with reference to FIG. 1. The channel 107 is created by vertically-extending walls 105 and 106. The vertically-extending walls 105 and 106 extend from a bottom surface 203 of the chip bowl lid 104.

The vertically-extending wall 106 defines an opening 202. The opening 202 is configured for receiving the dip bowl lid 103 when dip is contained in the dip bowl 102 for transport or when the chip and dip container 100 is being stored and not in use.

Additionally, the opening 202 is configured for retaining the dip bowl lid 103 when the chip and dip container 100 is in use. In this regard, the chip bowl 101 comprises an outer edge 206 of the bottom of the chip bowl 101. The outer edge 206 of the bottom of the chip bowl 101 is circumferentially smaller than the lip 121 of the chip bowl lid 104. Thus, while the chip and dip container 100 is in use, the dip bowl lid 103 may be placed within and secured by the opening 202 defined by the wall 106. Further, the chip bowl lid 104, which houses the dip bowl lid 103 during use, may be removably coupled to the outer edge 206 of the chip bowl 101, which is shown further with reference to FIGS. 4A and 4B.

The dip bowl 102 comprises the circular, vertically-extending protrusion 110 that extends from a bottom surface 205 of the dip bowl 102. The protrusion 110 fits within and is retained by the wall 115 (FIG. 1) of the opening 116 (FIG. 1) centrally located on the floor 114 (FIG. 1) of the chip bowl 101.

Additionally, the dip bowl 102 comprises a ledge 109. Further, the dip bowl lid 103 comprises a lip 108 that extends vertically from a bottom surface 207 of the dip bowl lid 103. The ledge 109 is configured for coupling to the lip 108 of the dip bowl lid 103 for transport or storage. The chip bowl 101 comprises the ledge 111. The ledge 111 is configured for coupling to the lip 121 for transport or storage.

Further, the chip bowl 101 comprises a wall 200 that vertically extends from a bottom surface 204 of the chip bowl 101. As will be described further herein, during use of the chip and dip container 100, the dip bowl lid 103 fits within the opening 202. Further, the bottom surface 204 of the chip bowl 101 is configured for receiving the chip bowl lid 104, which retains the dip bowl lid 103 in the opening 202, while the chip and dip container 100 is in use. Notably, the wall 200 extends a distance from the bottom surface 204 of the chip bowl to allow the dip bowl lid 103 to be placed in the opening 202 when the lids 103 and 104 are stored on the bottom of the chip bowl 101, which is described further with reference to FIG. 4B.

Note that, when assembled for storage or transport, the dip bowl 102 first within opening 116 (FIG. 1) of the chip bowl 101, thereby limiting movement of the dip bowl 102. Further, the dip bowl lid 103 is coupled to the dip bowl 102, and the chip bowl lid 104 is coupled to the chip bowl 101. When the dip bowl lid 103 is coupled to the dip bowl 102, the dip bowl lid 102 fits within the opening 202 thereby further limiting movement of the dip bowl 102.

Figure 3A:
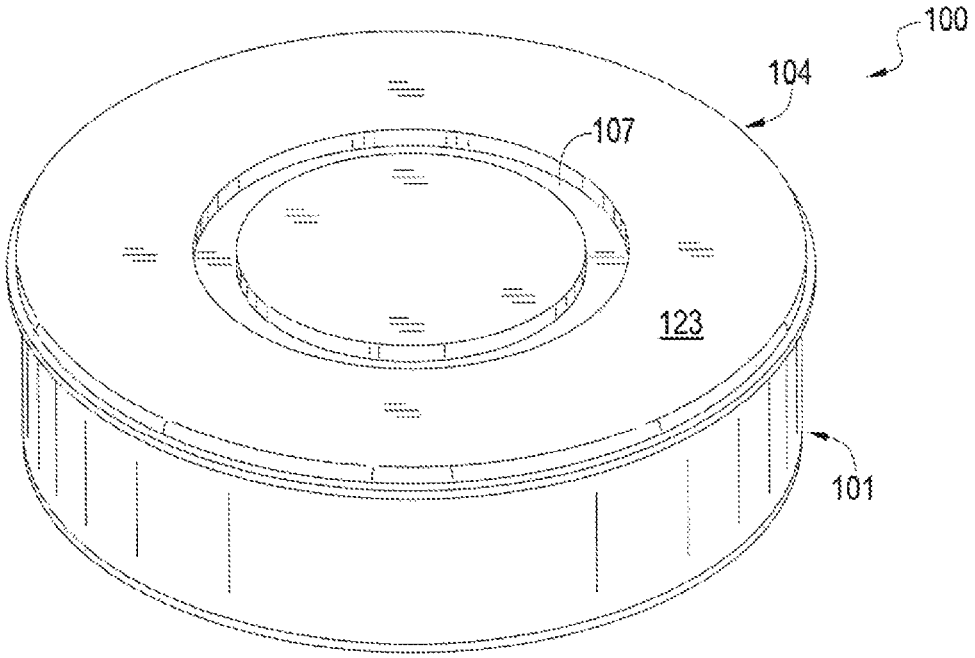
FIG. 3A is a top perspective view of the chip and dip container of FIG. 1.

FIG. 3A is a perspective view of the chip and dip container 100 wherein the lid 104 is coupled to the chip bowl 101. Note that the channel 107 is formed in the top surface 123 of the chip bowl lid 104. The channel 107 defines an opening 202 (FIG. 2) in a bottom surface 203 (FIG. 2) of the chip bowl lid 104 that is configured for receiving the dip bowl lid 103 (FIG. 2) when chips (not shown) and dip (not shown) are being transported or when the chip and dip container 100 is being stored.

Figure 3B:
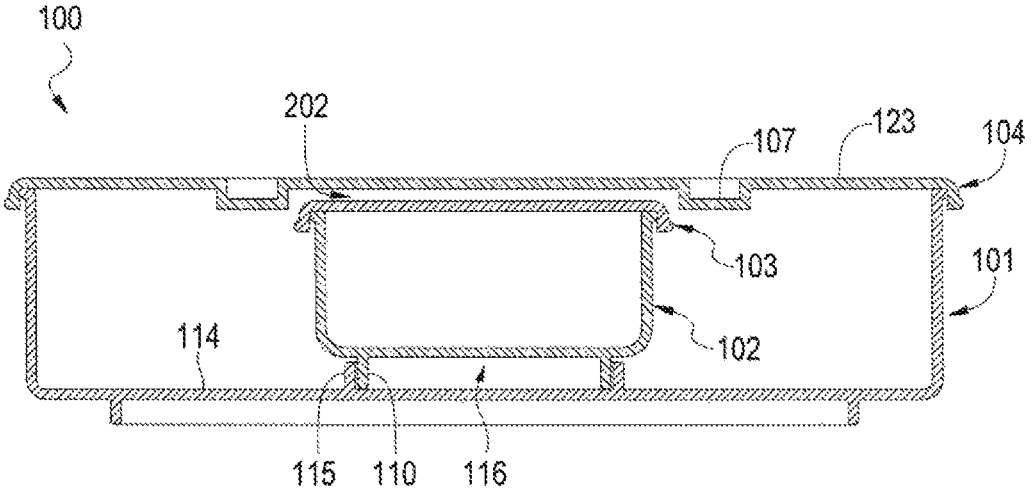
FIG. 3B is a cross-section view of the chip and dip container of FIG. 1 assembled for storage or transport.

FIG. 3B is a cross-sectional view of the chip and dip container 100 when the chip bowl lid 104 is coupled to the chip bowl 101 and the dip bowl lid 103 is coupled to the chip bowl 102. The opening 202 formed by the channel 107 is configured to receive the dip bowl lid 103 of the dip bowl 102 and to secure the dip bowl 102 when the chip and dip container is being transported or stored. Further, the circular, vertical wall 115 extends from the floor 114 and forms the opening 116. The opening 116 is configured for receiving the protrusion 110 extending from the dip bowl 102 to secure the dip bowl 102 when the chip and dip container is being transported or stored.

Figure 4A:
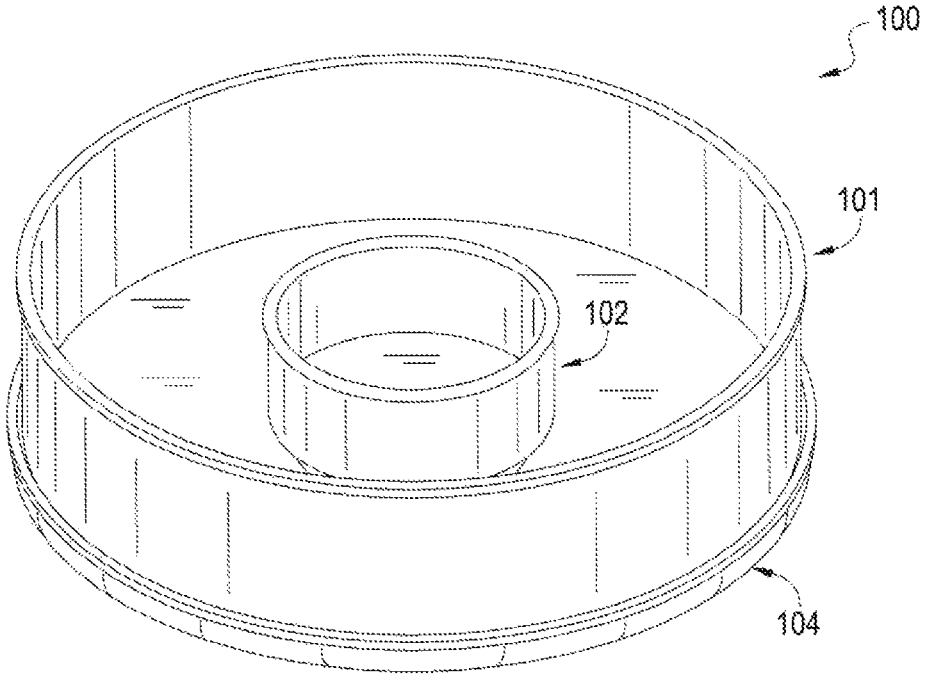
FIG. 4A is an exploded perspective view of a chip holder and a dip lid of FIG. 1.

FIG. 4A is a perspective view of the chip and dip container 100 when the chip bowl lid 104 and the dip bowl lid 103 (FIG. 2) are stored on the bottom of the chip and dip bowl 101. In this regard, the chip bowl lid 104 and the dip bowl lid 103 may be stored on the bottom of the chip bowl 104 when the chip and dip container 100 is being used to serve chips and dip.

Figure 4B:
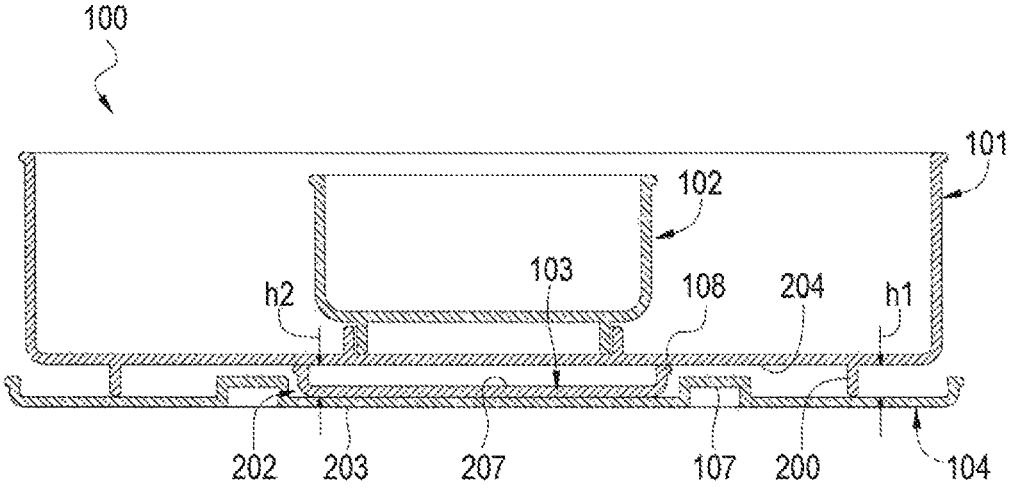
FIG. 4B is a cross-sectional view of the chip and dip container of FIG. 1 disassembled for serving.

FIG. 4B is a cross-sectional view of the chip and dip container 100 when the chip bowl lid 104 and the dip bowl lid 103 are stored on the underside of the chip bowl 101. In this regard, the chip bowl lid 103 and the dip bowl lid 104 may be stored on the underside of the chip and dip container 100 when chips (not shown) and dip (not shown) are being served from the chip and dip container 100. By storing the lids 103 and 104 on the underside of the chip and dip container 100, the lids 103 and 104 are easily located after use.

When the chip and dip container 100 is in use, the dip bowl lid 103 is housed in the opening 202 formed by the channel 107 of the chip bowl lid 104. Note that the chip bowl 101 is supported by the circular wall 200 and the lip 108 when the lids 103 and 104 are stored on the underside of the chip bowl 101.

As described above, the wall 200 extends from a bottom surface 204 of the chip bowl 101. Further, the lip 108 extends from a bottom surface 207 of the dip bowl lid 103. Both the wall 200 and the lip 108 contact and support the chip bowl 101 during use.

In this regard, the wall 200 extends a height $h_1$ from the bottom surface 203 of the chip bowl lid 104. Also, the lip 108 of the dip bowl lid 103 extends a height $h_2$ from a bottom surface 207 of. In one embodiment, the height $h_1$ of the wall 200 is equal to the height $h_2$ of the lip 108 such that the wall 200 and the lip 108 simultaneously contact the bottom surface 204 of the chip bowl 101.

What is claimed is:

1. A chip and dip container, comprising:

a dip bowl coupled to a dip bowl lid, the dip bowl having a first, circular, vertically-extending protrusion that extends vertically straight down from a bottom surface of the dip bowl;

a chip bowl coupled to a chip bowl lid, the chip bowl comprising a second, vertically-extending, circular wall that extends vertically straight up from a floor of the chip bowl, the second, vertically-extending, circular wall centrally located on the floor of the chip bowl and forming a first circular opening, the first circular opening secures the first vertically-extending protrusion thereby limiting movement of the dip bowl when in the chip and dip container is in transport or when the chip and dip container is being stored, wherein the chip bowl lid comprises a channel on an upper surface of the chip bowl lid, the channel created by second vertically-extending walls that extend from a bottom surface of the chip bowl lid, the second vertically-extending wall defining a second opening on an inner surface of the chip bowl lid, the second opening retains the dip bowl lid when the chip and dip container is in transport or when the chip and dip container is being stored, and wherein the second, vertically extending walls comprise a circular inner wall and a circular outer wall, wherein the channel is disposed on a top surface of the chip bowl lid.

2. The chip and dip container of claim 1, wherein the inner wall defines the second opening on a bottom surface of the chip bowl lid.

3. The chip and dip container of claim 1, wherein the second opening receives the dip bowl lid and retains the dip bowl when the chip and dip container is assembled and not in use or for transport.

4. The chip and dip container of claim 1, wherein the second opening houses the dip bowl lid when the chip bowl lid is coupled to a bottom of the chip bowl when the chip and dip container is disassembled.

* * * * *